United States Patent [19]

Vaubel et al.

[11] Patent Number: 4,480,976

[45] Date of Patent: Nov. 6, 1984

[54] ADJUSTABLE SLIDING MOLD FOR CONTINUOUS CASTING INSTALLATIONS

[75] Inventors: Gert Vaubel, Warburg-Welda; Heinz Beier, Paderborn-Schloss Neuhaus, both of Fed. Rep. of Germany

[73] Assignee: Benteler-Werke AG, Paderborn, Fed. Rep. of Germany

[21] Appl. No.: 471,146

[22] Filed: Mar. 1, 1983

[30] Foreign Application Priority Data

Mar. 3, 1982 [DE] Fed. Rep. of Germany ..... 3207579
Jun. 18, 1982 [DE] Fed. Rep. of Germany ..... 3222836

[51] Int. Cl.[3] ..... B22D 11/02; B22D 27/08

[52] U.S. Cl. ..... 425/186; 164/416; 164/435; 164/436; 164/447; 164/452; 164/491; 425/192 R; 425/224; 425/381; 425/432; 425/441; 425/451

[58] Field of Search ..... 425/380, 381, 224, 186, 425/192 R, 150, 441, 451, 432; 264/70; 164/416, 491, 452, 436, 447, 435

[56] References Cited

U.S. PATENT DOCUMENTS

| | | | |
|---|---|---|---|
| 3,082,496 | 3/1963 | Bungeroth et al. | 164/436 |
| 3,166,803 | 1/1965 | Ruckstuhl | 164/416 |
| 3,375,865 | 4/1968 | Boichenko et al. | 164/436 |
| 3,528,483 | 9/1970 | Mallener | 164/436 |
| 3,528,485 | 9/1970 | Vogel | 164/491 |
| 3,580,327 | 5/1971 | Khimich et al. | 164/435 |
| 3,592,258 | 7/1971 | Simons | 164/416 |
| 3,794,105 | 2/1974 | Voss | 164/416 |
| 3,838,730 | 10/1974 | Nagaoka et al. | 164/452 |
| 3,882,924 | 5/1975 | Fujikawa | 164/416 |
| 4,356,862 | 11/1982 | Gloor | 164/436 |

FOREIGN PATENT DOCUMENTS

| | | | |
|---|---|---|---|
| 48-31815 | 10/1973 | Japan | 164/435 |
| 386629 | 4/1965 | Switzerland . | |

*Primary Examiner*—Jeffery Thurlow
*Attorney, Agent, or Firm*—Michael J. Striker

[57] ABSTRACT

Disclosed is an adjustable sliding mold assembled of two angular mold pieces slidably engaging each other at two mating surfaces. Adjusting means, preferably in the form of a spindle, is hinged to an outer side of a mold part to move the same transversely to the extrusion channel. The movable mold part is formed with an arcuate guide surface extending transversely to the extrusion channel and cooperating with a stationary complementary bearing surface so that during adjustment of the width of the extrusion channel the guiding surface automatically adjusts the taper of the channel.

9 Claims, 9 Drawing Figures

ADJUSTABLE SLIDING MOLD FOR CONTINUOUS CASTING INSTALLATIONS

BACKGROUND OF THE INVENTION

The present invention relates in general to extrusion casting and in particular to an adjustable sliding mold for use in an extrusion installation for producing continuous castings of a substantially rectangular cross section.

In order to change the cross section of a continuous casting, in prior-art extrusion installations it was necessary to install another sliding mold of the required clearance. As a consequence, it was necessary to provide for a relatively large stock of expensive slide molds made of copper, and usually provided with cooling passages. Moreover, the exchanging operation necessitated a relatively long shutdown of the extrusion installation.

From the Swiss patent CH-PS No. 386 629 (FIG. 5), an adjustable sliding mold of the aforedescribed kind is known. This prior-art slide mold consists of two relatively light walls arranged parallel to each other and of two mold parts arranged at right angles to the two walls so as to complete a rectangular cross section of the slide mold. The clearance between the mold parts is variable by means of a spindle-like adjusting device. By fixing the adjustable mold part in a desired position, it is possible to achieve in a relatively simple manner a convergence of the extrusion channel of the mold matching in the known manner the shrinkage of the continuous casting upon its solidification. In principle, it is also possible in this prior-art mold to adjust the mutual position of the mold parts in a relatively large range so as to produce in the same sliding mold both broad and narrow extruded strands.

Nevertheless, it has been found that such prior-art adjustable sliding molds are possessed with disadvantages, particularly regarding the leak-tightness between the contact surfaces of the movable and fixed parts of the adjustable mold. The four mating surfaces of the mold parts must be carefully machined with relatively large expenditures in order to ensure proper operation of the device. Another problem arises from the fact that the guiding of the movable mold parts at right angles to the fixed mold parts requires an extreme accuracy in manufacturing these component parts. It has been found that in spite of considerable efforts in machining, a certain amount of seizing or slipping can hardly be avoided, resulting in waste of material.

SUMMARY OF THE INVENTION

It is therefore a general object of the present invention to overcome the aforementioned disadvantages.

More particularly, it is an object of the invention to provide an improved adjustable slide mold of the aforedescribed kind which in comparison with prior-art adjustable molds is less susceptible to leaks between the movable and fixed mold parts.

Another object of this invention is to provide such an improved adjustable mold in which the extruded castings can be accurately controlled.

Still another object of this invention is to provide an adjustable mold which is easy to manufacture.

In keeping with these objects and others which will become apparent hereinafter, one feature of the invention resides in the provision of a sliding mold assembled of two mutually shiftable angular parts. In contrast to the aforedescribed prior-art slidable mold assembled of two pairs of shiftable parts, the mold of this invention has only two contact surfaces between the adjoining parts. Consequently, when considering expenditures for solving the problems regarding the tightness of the mold at the contact surfaces, the mold of this invention divides such expenditures by half. Due to the rigidity of both angular mold parts, the inner walls always form a right angle, and consequently the aforementioned disadvantages, such as tilting or slipping of the assembled parts, do not occur.

A particularly stable and inexpensive arrangement of the mold of this invention is achieved when one of the angular mold parts is fixed and the other is adjusted in position to the fixed part according to the desired cross section of the casting to be extruded. The usual convergence of the extrusion channel in the mold is thus adjusted by one of the mold parts so that in the case of relatively narrow castings the convergence angle is relatively small while in the case of relatively broad castings the convergence angle is correspondingly increased.

If desired, it is possible of course to make both mold parts adjustable relative to each other. In this case it is advantageous when the two mold parts are symmetrically displaced from a central axis of the strand to be extruded and away from each other until the desired cross section of the strand is defined.

In a preferred embodiment of this invention, at least one of the mold parts is hinged to a spindle and is guided in an arcuate guideway so that the angular position relative to the other mold part be accurately defined. As mentioned before, in the case of narrow extrusion channels, the angle of convergence is set small, whereas in the case of broader castings to be extruded the convergence angle is larger. The guidway may have if desired another configuration, preferably in the form of a template which enables a continuous displacement of the movable mold part so as to achieve either a narrow or a broader extrusion channel. The template is shaped such that the corresponding convergence angle is automatically adjusted during the displacement of the mold part as a function of the adjusted clearance of the extrusion channel. The convergence angle can be also adjusted for a given width of the extrusion channel as an independent variable.

A particularly stable and inexpensive design of the sliding mold of this invention is obtained when the two mold parts have an L-shaped cross section defining a longer arm and a shorter arm, whereby the end faces of the shorter arm rest on the inner walls of the longer arm. The mold parts are free to slide on each other in the transverse direction relative to the axis of the extrusion channel. Due to the fact that the end faces are guided and supported on major inner surfaces of opposite parts, an excellent stability of the mold cross section is achieved. In this manner, any tilting or slipping of the mold parts from the adjusted position is eliminated by external compression means acting in the direction of shorter arms, thus imparting to the mold the quality of a one-piece mold.

As mentioned before, a problem-free adjustment of the relative position of the L-shaped mold parts and an automatic adjustment of the convergence angle is obtained by the provision of an arcuate guideway. This arcuate guideway is preferably constituted by an arcuate shape of a side wall of the longer arm of the movable mold part slidably engaging a complementary guiding piece arranged opposite the guiding lateral side wall. Theoretically, the adjustment of the angle of conicity of the extrusion channel is not proportional to the displacement of the adjustable mold part along the arcuate guideway because this displacement corresponds to a circular function. Nevertheless, in case of adjusting small convergence angles, the radius of the arcuate guideway is very large in comparison to the angle and in practice the increase of the width of the extrusion channel provides practically a proportional adjustment of the angle of conicity.

It has been found that it is sufficient for achieving good cooling of the extruded strand when only two inner walls of the mold converge relative to one another. This convergence or conicity, as discussed before, is adjusted by the mutual displacement of the two mold parts. The mold of this invention provides the desired adjustability of the mold cross section without impairing the tightness of contact between the mating surfaces of the mold parts. At the same time, the conicity of the extrusion channel is adjusted without affecting the effective length of this channel.

According to another embodiment of this invention, one of the sliding mold parts has a U-shaped cross section whereas the other part has a straight configuration matching the ends of the arms of the U-shaped part. Also in this embodiment there are only two contact surfaces between the mold parts. The smooth straight mold part, which preferably constitutes the smaller side of the assembled mold, may theoretically create certain problems regarding the position stability; nevertheless, due to the fact that three sides of the extrusion channel are defined by a one-piece mold part, any undesired change of the casting cross section resulting from tilting or slipping is completely eliminated.

In the first embodiment using the two L-shaped mold parts, it is frequently desirable to modify the adjustment of the conicity or taper of the extrusion channel by means of the arcuate guideways. According to another feature of this invention, the longer arm of at least one L-shaped mold part is provided with an exchangeable guiding rail of the arcuate shape. For this purpose the longer arm of the L-shaped mold part is formed with a straight groove in which the guiding rail is insertable. The curved part of the rail projects above the outer surface of the assigned mold part and cooperates with a corresponding complementary guiding piece.

In another embodiment, the angular component parts of the mold are designed such that the inner walls of the extrusion channel form an acute angle without creating any gaps during mutual adjustment of the angular mold parts. In molds of the type which possess exclusively straight edges in their construction, the mating surfaces of the mold parts, particularly the major inner sides of the long arms of an L-shaped mold part, have a configuration of a section of a crown shell defined by two parallel sections of a crown shell perpendicularly to the axis of symmetry of the mold. In other words, the major inner sides of the two mold parts form a section of an oblique angular surface. The end faces of short arms of L-shaped mold parts are of course complementary to the shape of the larger arms.

The invention is also applicable for molds having an extrusion channel formed of circular sections. Two inner sides of the mold, preferably the narrow sides, are made flat whereas the other major sides are curved. A problem-free position adjustment of such arcuate mold parts is achieved by shaping the inner surfaces thereof according to circles of a radius r whereby the center points of these circles are located on a circle which is concentric to that defining the arcuate guideway. In principle it is also possible to employ elliptical curved surfaces instead of circles of radius r, provided that the inner surface is defined by circles which are concentric to the circle defining the circular segment of the guideway; for manufacturing reasons, however, the embodiment employing the circular curve is employed.

In a preferred embodiment of this invention, a circular arc mold is provided in which the radius R of the circle defining the center points of the circular arcs equals the radius of the arcuate guideway plus the height of the mold. This means that, in the upper range of the inlet of the mold, the corresponding inner surface is practically vertical, and in the course toward the outlet it progressively inclines to a horizontal.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
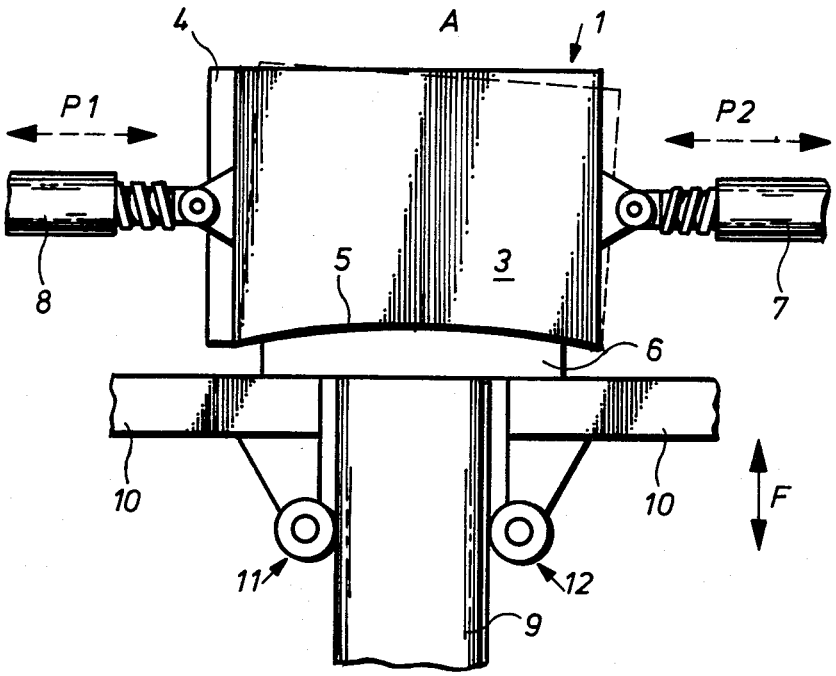
FIG. 1 is a schematic elevational view of a part of an extrusion installation with an oscillating sliding mold according to this invention.
Figure 2:
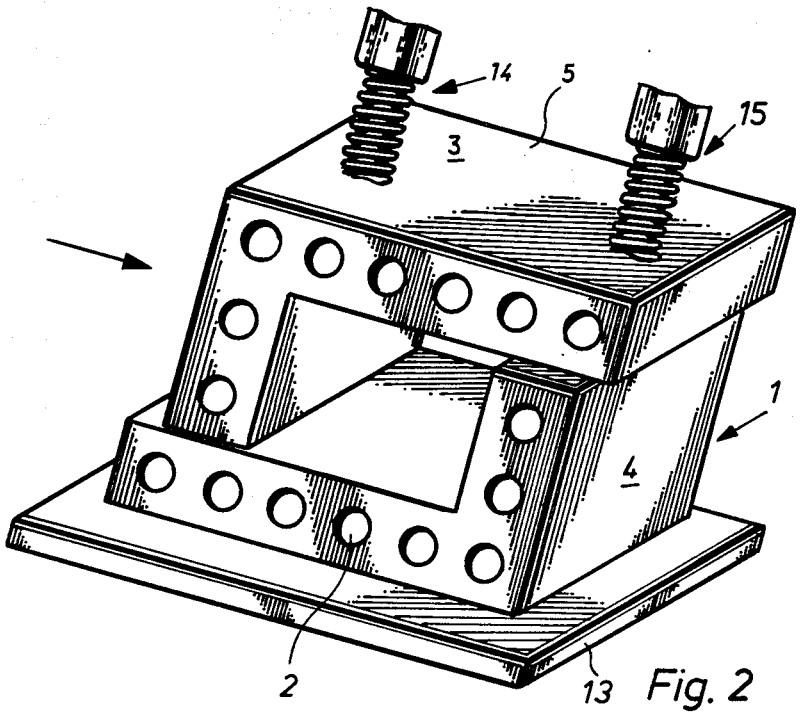
FIG. 2 is a perspective view of a sliding mold of this invention.

FIG. 1 shows schematically a part of a continuous casting equipment with a two-piece sliding mold 1 made of copper and having in this embodiment the configuration illustrated in FIG. 2. The lower end faces of longer arms of L-shaped mold parts 3 and 4 have the form of a circular arc to serve as arcuate guideways 5 slidably supported on complementary bearing piece 6 of a convex shape. The walls of each mold part are provided with transverse cooling channels 2.

In the embodiment of FIG. 1, shorter arms of the L-shaped mold parts 3 or 4 are hinged to spindles 8 or 7 which oscillate in the direction of arrows P1 and P2, thus imparting the corresponding oscillating movement to the linked mold parts. Due to the arcuate guiding surfaces 5 and 6, the mold parts are automatically tilted at a variable angle relative to the center axis of the extruded strand 9. This arrangement thus makes it possible not only to adjust the width of the casting 9 but also adjust the taper of the extrusion channel of the mold.

The arcuate bearing piece 6 rests on a frame 10 provided at its lower surface with guiding rolls 11 and 12 for guiding the discharged casting strand 9 exiting at the lower end of the mold channel. Frame 10 together with guiding rolls 11 and 12 is set by a non-illustrated oscillating drive in a rapid oscillatory motion along the longitudinal axis of the casting 9 as indicated by arrow F. In this known manner, the adhesion of solidified casting material to the inner walls of the extrusion channel is effectively prevented.

From FIGS. 1 and 2 it is also evident how the width of the extrusion channel and thus of the casting 9 can be adjusted by adjusting the mutual position of the two L-shaped mold parts 3 and 4. According to FIG. 2, the outer surface of the larger arm of the lower mold part 4 is supported on a stationary plate 13, whereas the outer surface of the long arm of the upper mold part 3 is acted upon by a plurality of compression springs 14 and 15. In this arrangement, the lower mold part 4 can be completely stationary and only the upper mold part 3 is moved by means of a non-illustrated spindle hinged to the outer surface of the shorter arm in order to adjust the width of the extrusion channel of the mold 1. It is of course possible to modify the arrangement of FIG. 2 so as to provide four or more counteracting compression springs holding the slidable parts of the molds together.

Figure 3:
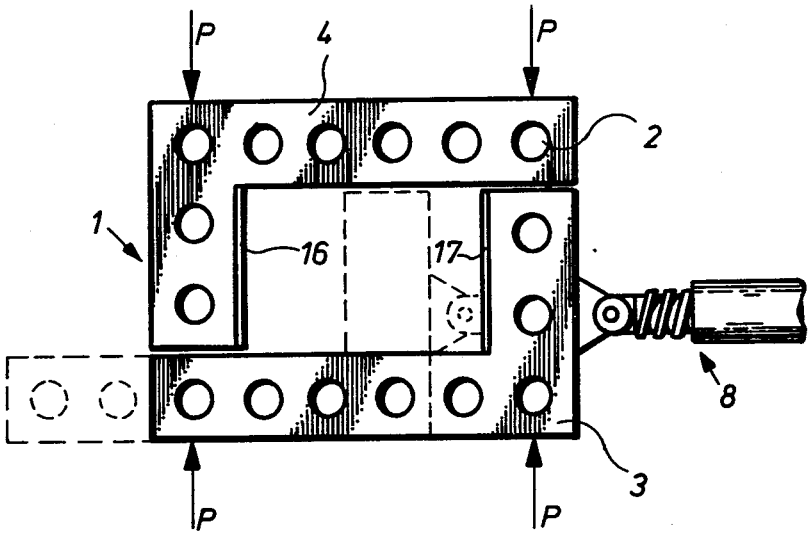
FIG. 3 is a plan view of a sliding mold of this invention.

In FIG. 3, arrows P indicate the forces of such springs acting at four points against the opposite L-shaped mold parts 3 and 4. In the wide open position as indicated in full lines in FIG. 1, the opposite narrow inner walls 16 and 17 converge at an acute angle relative to each other toward the inlet of the mold. When the spindle 8 is activated to reduce the cross section of the mold channel, the adjustable part 3 of the mold is displaced in the position indicated by dashed lines in FIG. 3. In doing so, the convergence of the inner surfaces 16 and 17 is automatically lessened due to the turning of the mold parts about the radius of the guideways 5 and 6, illustrated in FIG. 1.

Figure 4:
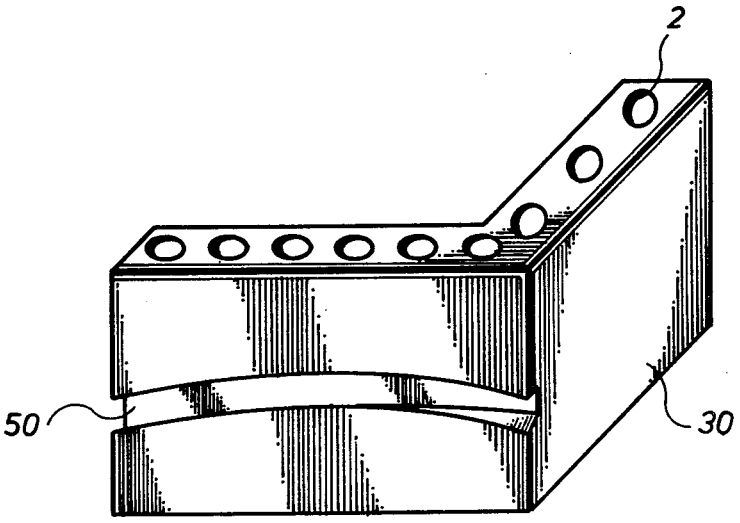
FIG. 4 is a perspective view of one mold part provided with an arcuate guideway.

In contrast to the embodiment of FIG. 1, where the arcuate guiding surfaces 5 are formed in the lateral end faces of long arms of respective L-shaped parts 3 and 4, in the embodiment according to FIG. 4 the circular arc guideway is in the form of an arcuate groove 50 in the outer surface of one arm of the L-shaped mold part 30. The long arm of the part 30 with the guiding groove 50 in this embodiment is pressed against a flat guiding plate provided with an arcuate spring engaging in the arcuate guiding groove 50. The arcuate spring can be substituted for two guiding pins arranged on the plate at a distance from each other and engaging the guiding groove 50 to change during the lateral displacement of the mold parts the angular position of the same relative to the center axis of the extrusion channel. Alternatively, the arc-shaped guiding groove can be formed also in the bearing plate, whereas the outer surface is formed with projections guided in the groove.

If it is desired to modify the range of the angular displacement of the movable part of the mold, it is of advantage when the latter is provided with exchangeable arcuate guiding means. For this purpose, in the long arm of at least one mold part a straight groove is formed into which an exchangeable rail is inserted. The projecting part of the rail has an arcuate configuration corresponding to the desired range of variation of the taper of the extrusion channel.

By means of the continuous casting installation of this invention, it is possible to extrude castings of different width without the necessity of exchanging the casting mold. It is only necessary to adjust the mutual position of the two mold parts, whereby the adjustment of the taper of the extrusion channel is made automatically as explained above. On the other hand, it is to be recommended that the range of adjustment of the mold be not excessively large. For the manufacture of casting strands within a relatively large range of the strand width, it is advantageous to use two adjustable molds of this invention. One of the molds can be designed for example such as to be capable of producing slabs between 250×250 and 250×325 mm in cross section, whereas the other adjustable sliding mold be adapted for manufacturing slabs in the range between 250×325 to 250×400 mm. The length of the first-mentioned mold is for example 400 mm, whereby the taper of the inner walls of the extrusion channel which are spaced at a fixed distance from each other amounts to 2 mm. The taper of the mutually adjustable opposite inner walls of the extrusion channel is 2.7 mm. The adjustable inner walls can be also formed with a broken taper. In the second, larger mold, the conicity of the fixed or non-adjustable opposite sides of the extrusion channel can be dispensed with, whereas the adjustable range of the taper between the larger sides amounts to about 4 mm. The latter taper of the extrusion channel is broken, that is stepped off.

In the sliding mold having the above described dimensions, the two L-shaped mold parts are pressed against one another at four points with a force of 1.5 to 4 tons, respectively. When the two mold parts are being adjusted in position relative to one another, in order to change the cross section of the extruded strand, the compression force is reduced to about 0.5 ton, at which force the parts can be relatively easily shifted.

The position adjustment or mutual shifting of the mold parts in the aforedescribed embodiments is made by means of an adjusting device including one or more setting spindles. The adjusting device provided with spindles hinged to the mold part enables accurate setting of the mutual position of the part and in addition prevents the parts from accidental displacement during casting. If desired, different types of adjusting devices, such as for example hydraulic devices, can be used.

The invention is not limited to L-shaped parts with rectangular inner walls. In another embodiment, one mold part has a U-shaped cross section, whereas the other part is in the form of a straight piece fitting between the arms of the U-shaped first part. The U-shaped part preferably is supported in a fixed position, whereas the straight part is slidably displaced toward bridging end portion of the U-shaped part according to the desired variation of the width of the extruded strand. Alternatively, the straight mold part can be rigidly supported, whereas the U-shaped mold part is displaceable. In order to adjust the taper of the extrusion channel, an outer surface of the U-shaped part is provided with arcuate guideways similarly as in the embodiments of FIGS. 1 or 4 which during the adjustment of the width of the extrusion channel automatic provide for the desired taper.

Figure 5:
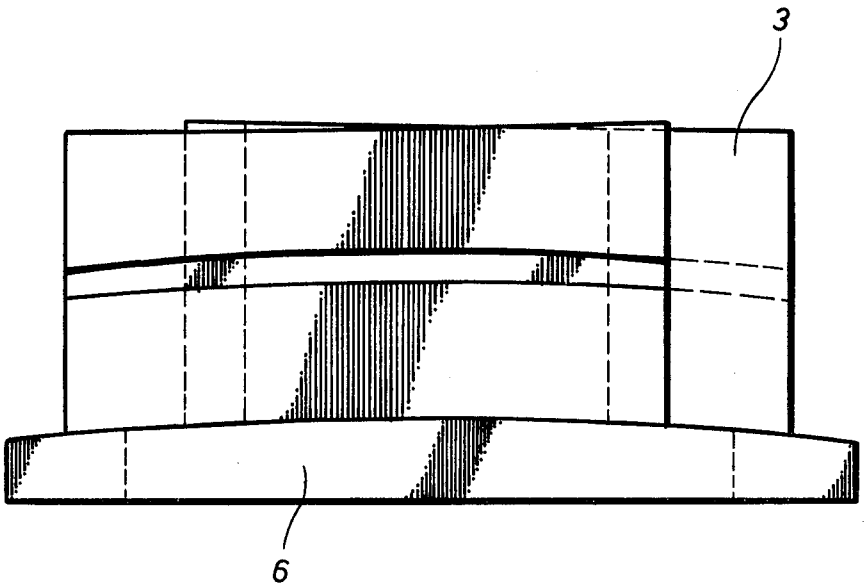
FIG. 5 is a side view of a sliding mold of this invention provided with arcuate guiding means.

FIG. 5 illustrates an embodiment in which both the outer U-shaped part and the inner straight part 3 are slidably guided on an arcuate guiding surface 6 so that when the width of the extrusion channel is adjusted within the limits indicated by dashed lines, the taper of the adjustable inner walls of the mold is adjusted in proportion to the set width.

If it is desired that all opposite inner walls of the mold always form an acute angle, the following design is employed in order to obtain optimum sealing between the mating surfaces of the mold parts in any position over the adjustment range. According to this invention, the inner surface of the long arm of an L-shaped mold part and the corresponding narrow end faces of the short arm which slidably engages the inner wall of the other mold part are curved so as to conform to sections of a circular cone. The sections thus correspond to portions of the jacket of the cone when cut perpendicularly to the center axis of the latter at different levels. In this manner, the slidable mating surfaces of the two mold parts always ensure a uniform optimum seal in any adjusted position. The resulting extrusion channel in the sliding mold according to this embodiment has straight edges of their inner surfaces.

Figure 6:
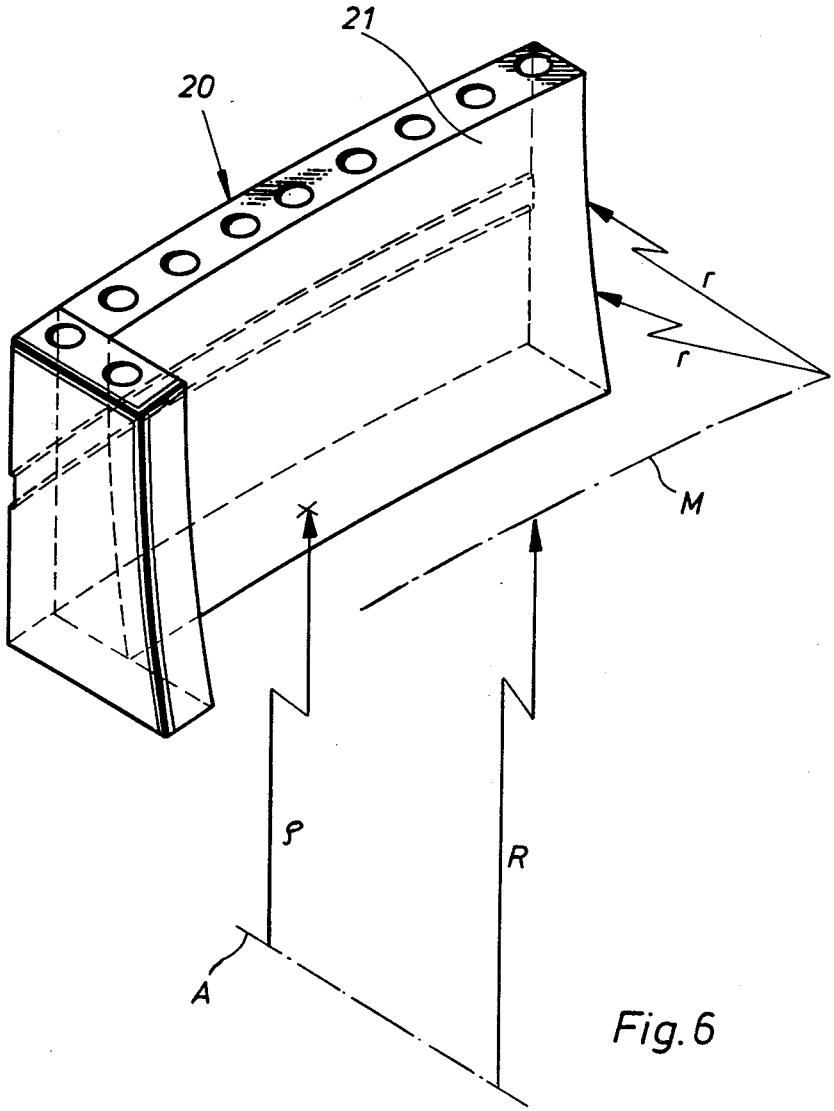
FIGS. 6 and 7 show respectively a perspective view of an L-shaped mold part of a circle-curved mold.
Figure 7:
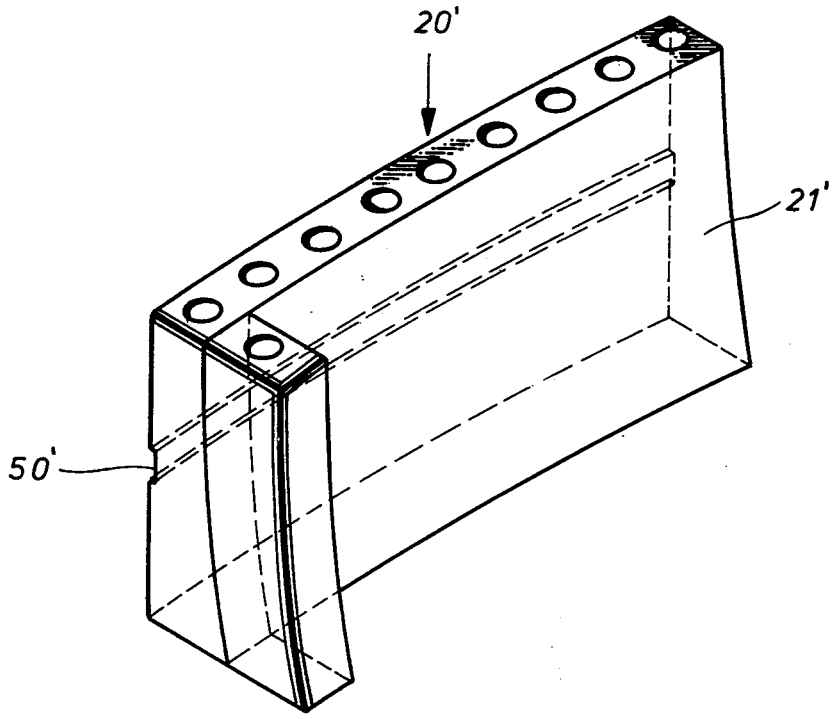

In the embodiment according to FIGS. 6, and 7, the L-shaped mold parts 20 or 20' define an extrusion channel with a cross section curved according to circular arcs. The modifications shown in FIGS. 6 and 7 differ one from the other only by a different assembly of the long and short arms of the two mold parts. In both embodiments, the inner surface 21 of the long arm of the mold parts 20 is curved, whereas the inner surface of the short arm is flat.

Figure 8:
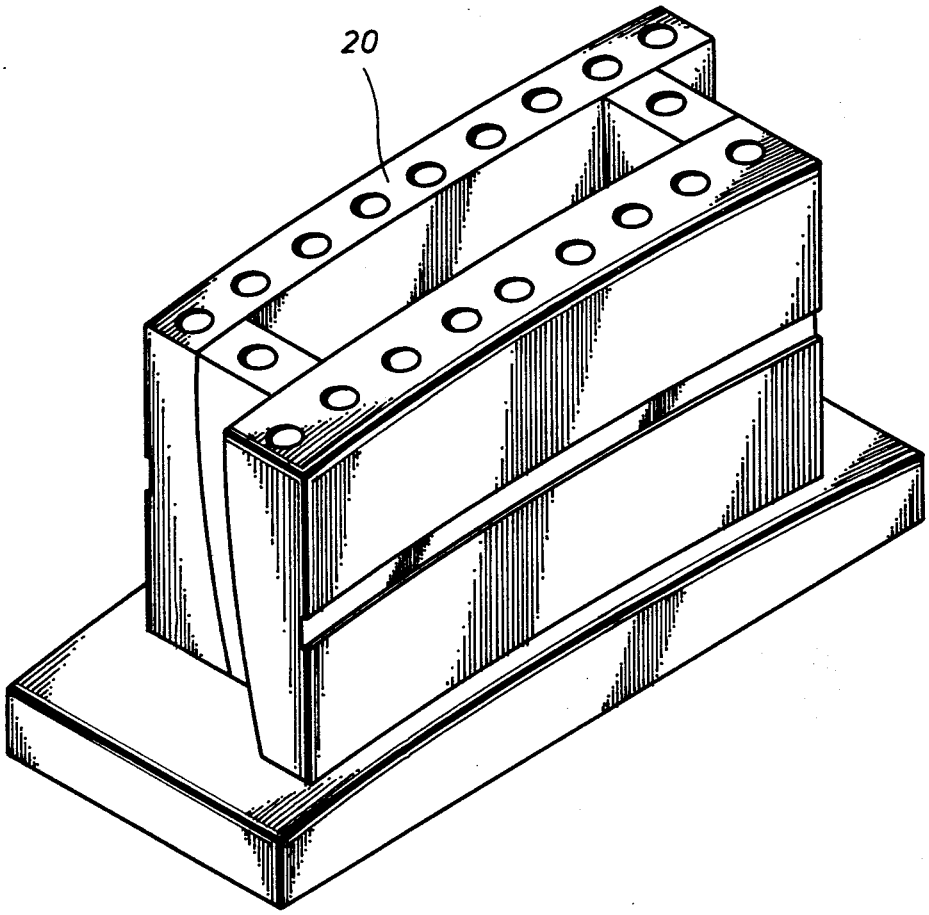
FIG. 8 is a perspective view of a circular arc mold of this invention.
Figure 9:
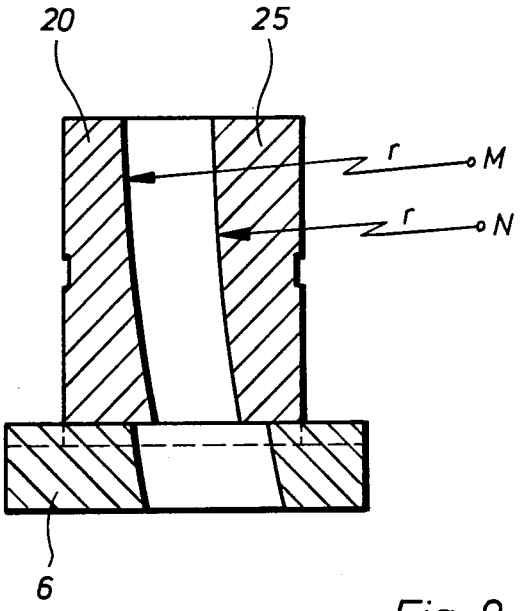
FIG. 9 is a sectional side view of the mold of FIG. 8.

From the following considerations it will be apparent how such circular arc molds achieve an optimum seal between the two mold parts in spite of the broad adjustment range. In FIG. 6, reference character A denotes a line passing through the center point of a circle M the curvature of which corresponds to the arcuate guiding surface formed on the bottom side of the long arm 20 and indicated by a radius $\rho$. The inner surface 21 of the long arm of the mold part 20 has a curvature defined by a toroidal section of a radius r centered on the circle M. The mating end face of the short arm of the other mold part has a complementary curved configuration. The mold parts depicted in FIGS. 6 and 7 have a concave inner surface and consequently the complementary end face of the short arm of the other mold part has a convex configuration as seen from FIGS. 8 and 9.

The desired taper of the two curved inner walls of the mold is obtained, in spite of the fact that the curvature of both the concave and the convex inner wall is of the same radius by adjusting the position of the center circle M of the toroid pertaining to the concave inner wall of mold part 20 relative to the circle N of the toroid pertaining to the other mold part 25. In this example, the center line N is lower than the center line M.

As a result, the curved mold parts are always in gap-free contact with each other in any adjusted position. This arrangement makes it possible to design adjustable molds formed with multiple stepped-off tapers which in vertical direction conform the radii of the casting machine and in horizontal direction to the radius of the arcuate guiding surfaces. The resulting molds meet all requirements of modern, efficient casting installations for extruding metal slabs or strands.

The manufacture of the aforedescribed mold parts is preferably made by digitally controlled machine tools. Inasmuch as the mold of this invention consists of only two one-piece mold parts, from the manufacturing standpoint it is simpler and more cost-effective when both arms of each mold part are manufactured separately and subsequently joined together, for example by means of screws.

It will be understood that each of the elements described above may also find a useful application in other types of constructions differing from the types described above.

This invention makes it possible to shape the inner surfaces of the mold into any desired configuration of its cross section without impairing the optimum leakproof seal of the two sliding mold parts. The strand profile of the extruded ingots or slabs corresponds to the horizontal section through the mold. In the mold having a curved cross section, the profile of the casting, due to the spherical configuration of the inner surfaces of the long arms of the mold parts, differs from an ideal rectangle or slab. Nevertheless, this deviation for all practical purposes is negligible in view of the sizes and formats of radii related to the taper. In the embodiment according to FIG. 6, the radius $\rho$ amounts to between 50 and 60 meters, radius r is about 10 meters, and the radius R for a mold length of about 700 mm corresponds also to 50 to 60 meters.

A compact construction is achievable also in the case when in contrast to the aforedescribed embodiments, the driving means for displacing the mold parts are attached to long the arms of the L-shaped parts instead to the short arms.

While the invention has been illustrated and described as embodied in a continuous die casting installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An adjustable sliding mold for use in extrusion installations producing continuous castings, comprising two L-shaped mold parts each defining a short arm and a long arm, said mold parts slidably engaging each other at two contact surfaces and forming together an extrusion channel of a substantially rectangular cross section, means for slidable adjusting the mutual position of the two mold parts in a direction transverse to the extrusion channel, at least one of the mold parts being hinged to adjusting means which moves the parts in direction transverse to the extrusion channel, and guiding means for adjusting the angular position of the movable one part relative to the other part proportionally to its transverse displacement so that in increasing the width of the extrusion channel its taper is increased, and vice versa.

2. A sliding mold as defined in claim 1 wherein said guiding means is constituted by an arcuate guiding surface on a movable mold part and by a complementary bearing surface slidably engaging the guiding surface, to automatically adjust the taper of the extrusion channel during the transverse movement of the adjustable mold part.

3. A sliding mold as defined in claim 2, wherein the mutually non-adjustable inner surfaces of the extrusion channel taper at a fixed angle toward each other.

4. A sliding mold as defined in claim 1, wherein at least one of the mold parts is provided with exchangeable guiding means, said exchangeable guiding means including a receptacle in the long arm of the mold part, an exchangeable rail insertable into the receptacle and having a curved projecting part cooperating with a complementary bearing member.

5. A sliding mold as defined in claim 2, wherein the mating surfaces of the L-shaped mold parts have a configuration of a transfer section of a jacket of a truncated cone.

6. A sliding mold as defined in claim 1, wherein at least two opposite walls of the extrusion channel are curved in accordance with a toroid having a radius r which is concentric with a circle M, and further comprising arcuate guiding means arranged on at least one mold part, whereby the radius of curvature always corresponds to the radius of the circle M.

7. A sliding mold as defined in claim 6, wherein the radius R of the circle M corresponds to the radius of curvature of the guiding means plus the clearance of the extrusion channel.

8. A sliding mold as defined in claim 6, wherein the radius of curvature of the arcuate guiding means is between 50 and 60 meters and the radius r of curvature of the opposite inner walls of the extrusion channel is about 10 meters, and the length of the mold is about 700 millimeters.

9. A sliding mold as defined in claim 1, wherein said adjusting means includes a spindle hinged to an outer surface of at least one of said mold parts.

* * * * *